United States Patent [19]

Rollyson

[11] 4,132,044

[45] Jan. 2, 1979

[54] HIGH-STRENGTH WINDOW ASSEMBLY

[75] Inventor: James H. Rollyson, Ocean Ridge, Fla.

[73] Assignee: Rollyson Aluminum Products, Inc., Ironton, Ohio

[21] Appl. No.: 754,317

[22] Filed: Dec. 27, 1976

[51] Int. Cl.[2] ..... E06B 3/54

[52] U.S. Cl. ..... 52/775

[58] Field of Search ..... 52/498, 502, 400, 282

[56] References Cited

U.S. PATENT DOCUMENTS

| | | | |
|---|---|---|---|
| 2,342,352 | 2/1944 | Lowry | 52/502 |
| 3,363,385 | 1/1968 | Evans et al. | 52/498 |
| 3,487,601 | 1/1970 | James | 52/498 |

FOREIGN PATENT DOCUMENTS

| | | | |
|---|---|---|---|
| 1137170 | 1/1957 | France | 52/498 |
| 1521097 | 3/1968 | France | 52/498 |

*Primary Examiner*—J. Karl Bell

*Attorney, Agent, or Firm*—Murray and Whisenhunt

[57] ABSTRACT

A prime window assembly is disclosed, wherein the assembly comprises a window pane and a frame assembly surrounding the pane. The frame assembly includes a frame and a removable glazing member. The frame has a first molding which receives the window pane, with the pane generally cushioned by bedding compound. The frame also has a second molding for engaging one end of the glazing member. Finally, the frame has hook engaging means located between the first and the second moldings.

The glazing member has a retaining flange at one edge for engaging the second molding on the frame, and a glazing bead on the opposite side of the glazing member for contacting the pane. A hook-shaped flange extends away from the glazing member in a position to be hookedly interengaged with said hook engaging means in the frame when the window pane is placed under load, such as by high winds. However, under no-load conditions, the hook-shaped flange and the hook engaging means are not interengaged, and the glazing member can be simply and easily removed from the frame.

With the disclosed construction, the window assembly is capable of resisting high wind loads, even up to the breaking point of the pane, yet the window pane can be easily installed in or removed from the frame.

4 Claims, 5 Drawing Figures

HIGH-STRENGTH WINDOW ASSEMBLY

BACKGROUND OF THE INVENTION

The present invention relates to a window assembly which comprises a window pane and a frame assembly therefor. The frame assembly includes a rigid frame and a glazing member, with the pane located between, and retained by, a molding on the frame and the glazing member.

Prior prime window assembly construction generally involved an extruded aluminum frame, with a single or double pane of glass mounted therein (with the double pane being for insulating glass). The aluminum metal framing member generally has a bedding compound located between it and the window pane, with the glazing member, such as a member of rigid vinyl or the like, retaining the window within the frame.

Such prime window assemblies can normally be quickly assembled, and the glazing member can be removed intact for window pane replacement. One prior art window assembly comprised an extruded aluminum channel-shaped frame having an upstanding member to receive the glazing bead member. The glazing bead member had a downwardly extending leg having a lip, which was designed to fit beneath the glass pane. This assembly causes constant pressure on the glass and has a tendency to bow the window frame. Because of this bowing tendency, it has been considered necessary to place the assembly in a jig to retain the frame in proper alignment until the bedding compound is set or cured. The cured bedding compound tends to hold the assembly in relatively acceptable alignment, but even then bowing problems can result.

Some eight to ten years ago, the assignee introduced a new construction wherein the extruded frame included two upstanding legs, one designed for use with a single pane and one designed for use with a double pane, with only one of the upstanding legs being used for a given assembly. The outer and inner portions of the plastic glazing strip abutted upstanding members on the frame, with the glazing strip thus compressed between the frame members so that the pressure on the window itself was minimized. This avoided the bowing problems faced by prior construction, and resulted in an assembly which was very acceptable for normal conditions.

However, such a construction does have a tendency for the glazing strip to be dislodged by wind pressure. Wind pressure upon the window tends to push the window inwardly, which tends to buckle the glazing strip and to rotate same about the inwardmost upstanding member of the frame which is in engagement with the glazing strip. Such movement of the glazing strip allows the outermost leg of the glazing strip to disengage from the upstanding frame member, and upon such engagement the glazing strip will pop out of engagement with the window frame. Normally such windows have difficulty in withstanding wind speeds in excess of 50 m.p.h., for normal sized windows.

DESCRIPTION OF THE INVENTION

The present invention relates to a window assembly which comprises a window pane and a frame assembly generally surrounding the pane. The frame assembly includes a frame, and a removable glazing member. In cross-section the frame has an interior side and an opposite, exterior side, and an inner side and an opposite, outer side. The plane of the exterior sides and the interior sides are generally parallel to the plane of the pane, and the plane of each inner side and the plane of each outer side is generally perpendicular to the plane of the pane.

The frame has an inwardly extending first molding on the exterior side thereof, an inwardly extending second molding on the opposite side thereof, and a flange area extending between the first and second moldings. Hook engaging means are located on the frame generally between the first and second moldings.

The glazing member includes a retaining flange at one end thereof for engaging the second molding on the frame, a glazing bead on the opposite side of the glazing member from the retaining flange means for contacting the window frame, and a hook-shaped flange means extending generally outwardly of the glazing member in a position to hookedly interengage the hook engaging means on the frame. The window pane is located between, and retained in the frame by, the first molding and glazing bead.

When the window pane is under substantially no load, the hook-shaped flange means and the hook engaging means are not interengaged, but when load is applied to the exterior of the pane, the glazing member rotates away from flange about the second molding to place the hook-shaped flange means in hooked interengagement with said hook engaging means. This hooked interengagement prevents further rotational movement of the glazing member away from the flange about the second molding. The hook-shaped flange means and the hook engaging means cooperate so that the glazing bead is insertable in and removable from the frame without damage to either the glazing member or the frame.

The construction described above must include a locking bead or hook on the lower edge of a glazing strip leg, with a mateable portion on the corresponding portion of the frame. These portions are sized so that the glazing strip can be moved into position with the same relative ease as with the prior art window assemblies, but the glazing member will remain in place, even in the event of very high wind loads, to keep the window in place. The glazing strip can resist wind loads up to the breaking point of the window pane itself, in certain instances.

The wind pressure on the exterior of the window pane, results in buckling of the glazing member, causing rotation which forces the locking bead into the corresponding configuration of the frame. Thus, the glazing member is locked into position against vertical movement, and the glazing member is kept from popping out of the frame.

While the frame is preferably of extruded aluminum, it will be readily appreciated that the frame can be made of other rigid material, such as suitable rigid plastics, including, for instance, vinyl plastics, and the like, or the frame could also be made of other metals.

The glazing member is preferably of rigid vinyl, but other suitable plastics may be utilized. In addition, hard rubber and similar materials could also be used, but are definitely not preferred. With a rigid vinyl glazing member, a typical wall thickness might be 0.024–0.030 inches, although the thickness of the glazing member can vary widely, depending upon the characteristics of the material from which it is constructed, and the other dimensions of the glazing member. Normally, the glazing member may have a maximum dimension, across the exposed inner, interior surface, of about 1 inch, although again this space can vary considerably, as desired.

While the present development is particularly useful in providing prime glass window assemblies, it will be readily appreciated that the glass window pane may be replaced by other sheet materials. For instance, the pane could be of clear plastic. Alternatively, the use of translucent or even opaque sheet material can also be used, such as, for instance, in the installation of curtain walls.

From the above, it will be appreciated that the leg of the glazing strip has a lockable bead or hook, with a similar matching configuration on an engaging member of the frame. The glazing strip is as easily inserted as the strips of prior manufacture, and when in the unpressured condition the glazing strip is unlocked and can be readily removed. However, when under pressure conditions, rotation of the glazing strip causes the locking bead to lock into place in the mating configuration of the frame, so that further rotational movement, and thus disengagement from the frame, is prevented.

The shape of the glazing strip may vary considerably, but it must be capable of easy insertion into the window frame and must be rotatable into a locking position. Normally, the hook-shaped flange means on the glazing member, which extends generally outward of the glazing member, will have a plurality of angles to form a curvature which permits rotation of the glazing member about the hook engaging means of the flange upon insertion. The shape of the glazing strip must provide the necessary clearance so that upon the loading of the window pane, by wind pressure or the like, the glazing strip is permitted to rotate to the lock position.

Wind tests have been performed on glass window assemblies of the present invention, and under the test conditions, the glass pane itself broke out of the test window at 188 m.p.h., the frame was bowed about 1 inch, but the glazing bead did not pop out of the frame. Surprisingly, this test involved a test window in which the window pane (about 7ft. by 53") was accidentally broken shortly before the test was run. The insert was reglazed and the abovedescribed wind load test was conducted without giving the bedding compound time to set up or cure. These results indicate that the use of the hook-shaped flange means and cooperating engaging means increase the wind load resistance of the window assembly by a factor of at least 3, in this particular instance.

Two windows were tested according to the ANSI A134.1 specification. These tests were conducted by an FHA authorized aluminum window and door certifying agency. In one test, wherein the awning window was rated A-B1-HP (68), the window had five vents, the four upper being 52" by 14½" and the bottom vent being 52" by 15½". The window was glazed with the glazing bead of the present invention. The bedding compound was Schnee-Morehead 5525, and the frame corners were sealed with Schnee-Morehead 5514 seam sealer. All corners of each vent were sealed with the same seal sealer.

| Paragraph Number | Title of Test | Measured | Allowed |
|---|---|---|---|
| 2.1.4.1 | Air Infiltration | 0.19 cfm/ft of crack | 0.75 cfm/ft. |
| 2.1.4.2 | Water Resistance at 2.86 psf | No leakage | No leakage |
| 3.1.2.1 | Water Resistance | No leakage | No leakage |

-continued

| Paragraph Number | Title of Test | Measured | Allowed |
|---|---|---|---|
| | at 6.24 psf | | |
| 2.1.4.3 | Uniform Load Deflection | 0.146" | 0.275" |
| 2.1.4.4 | Uniform Load Structural | | |
| | -Exterior: | 40 psf | 40 psf |
| | (No glass breakage, permanent deformation or other damage causing the unit to be inoperable.) | | |
| 2.1.4.5 | Uniform Load Structural | | |
| | -Interior: | 20 psf | 20 psf |
| | -Permanent Set: | 0.038" | 0.193" |
| | (No glass breakage, permanent deformation, or other damage causing the unit to be inoperable.) | | |
| 3.1.2.2 | Uniform Load Structural | | |
| | -Exterior: | 68 psf | 40 psf |
| | -Interior: | 45.1 psf | 26.8 psf |
| | -Permanent Set: | 0.103" | 0.193" |
| | (No glass breakage, permanent deformation, or other damage causing the unit to be inoperable.) | | |

The wind load applied to this window was equivalent to a wind of 160 m.p.h.

The other window, which received a designation DH-B1-HP (61) had one operating sash 50⅜" by 42½", with two spring-type extruded aluminum latches at sash bottom rail. The same bedding compound and seam sealer compound was used with this window. The results are as follows:

| Paragraph Number | Title of Test | Measured | Allowed |
|---|---|---|---|
| 2.6.4.1 | Air Infiltration | 0.17 cfm/ft. of crack | 0.75 cfm/ft. |
| 2.6.4.2 | Water Resistance at 2.86 psf | No leakage | No leakage |
| 3.1.2.1 | Water Resistance at 4.51 psf | No leakage | No leakage |
| 2.6.4.3 | Uniform Load Deflection | 0.130" | 0.288" |
| 2.6.4.4 | Uniform Load Structural | | |
| | -Exterior: | 20 psf | 20 psf |
| | -Interior: | 10 psf | 10 psf |
| | -Permanent Set: | Negligible | 0.288" |
| | (No glass breakage, permanent deformation, or other damage causing the unit to be inoperable.) | | |
| 3.1.2.2 | Uniform Load Structural | | |
| | -Exterior: | 61 psf | 40 psf |
| | -Interior: | 40.7 psf | 26.8 psf |
| | -Permanent Set: | Negligible | 0.288" |
| | (No glass breakage, permanent deformation, or other damage causing the unit to be inoperable.) | | |
| 2.6.4.5 | Horizontal Load | 0.052" | 0.219" |
| 2.6.4.6 | Vertical Load | 0.091" | 0.094" |

In summary, the window assembly of the present invention utilizes a glazing strip which is easily insertable and removable, yet which adds significantly to the ability of the window assembly to resist wind loads. The appearance of the installed glazing strip is the same as prior art glazing strips, so that no radical departures in appearance will be noted by the consumer. The window frame is kept from bowing by compression of the glazing strip between the window and the frame, and thus the window assembly of the present invention retains the desirable features of the prior art, while providing a major increase in the strength of the assembly.

DETAILED DESCRIPTION OF THE DRAWINGS

The present invention will be understood more readily from consideration of the drawings, wherein.

Figure 1:
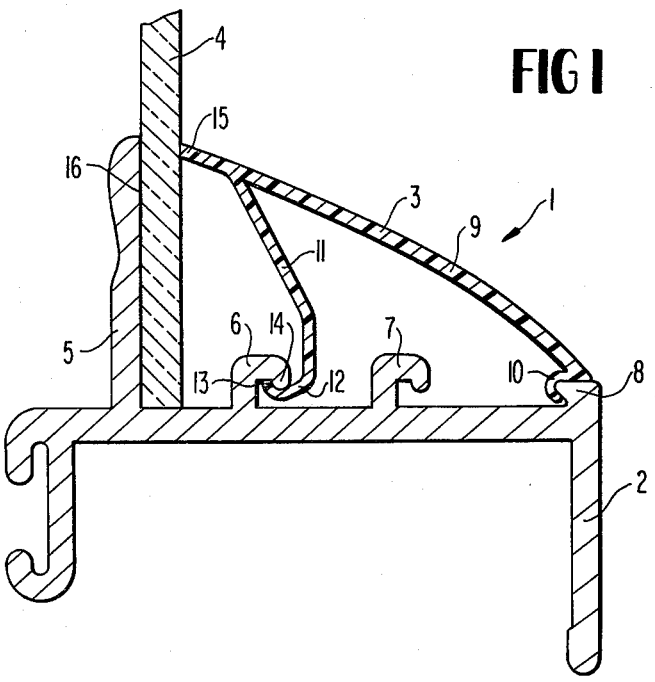
FIG. 1 is a cross-sectional view of a portion of the window pane, a portion of the frame, and the glazing strip of the window assembly of the present invention.

In FIG. 1, window assembly 1 includes a frame 2, a glazing strip 3, and a window pane 4. Frame 2 includes a first molding 5, a hook engaging upstanding portion 6, a second hook engaging upstanding portion 7, and a second molding 8, with each of members 5, 6, 7 and 8 extending inwardly of the frame 2. The glazing strip 3 includes a flange area 9, preferably curved in cross-section, extending between retaining flange 10 and glazing bead 15. Leg 11 extends generally outward of the glazing member, and includes a lower portion 12 which has a hook-shaped member 13 at the exterior edge thereof. Hook 13 is mateable with hook 14 on member 6. Glazing compound 16 is between first molding 5 and pane 4, which is retained in the desired position by glazing bead 15.

Figure 2:
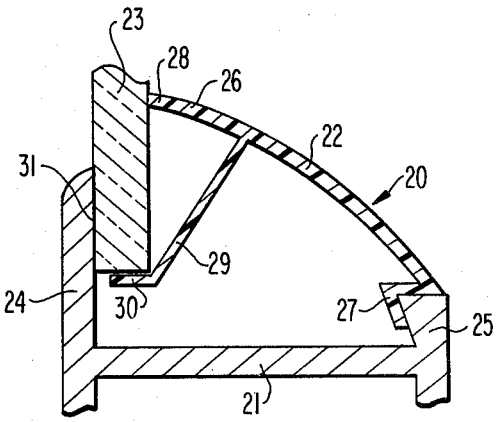
FIG 2 PRIOR ART
FIG. 2 is a cross-sectional view of similar members, of prior art construction.

In contrast, FIG. 2 illustrates the prior art construction, wherein window assembly 20 includes a frame 21, a glazing strip 22, and a window pane 23. Frame 21 includes a first molding 24 and a second molding 25. Glazing strip 22 includes a flange 26 extending between retaining flange 27 and glazing bead 28. Leg 29 extends generally outwardly of the glazing member 22, and includes a member 30 which is inserted under the edge of window pane 23. Bedding compound 31 is located between the first molding 24 and pane 23.

Figure 3:
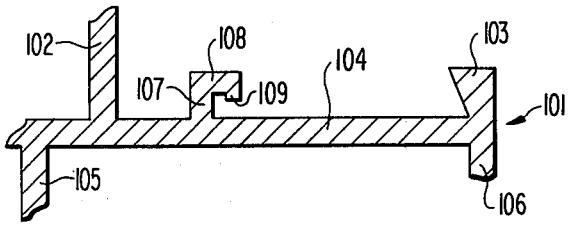
FIG. 3 is a cross-sectional view of part of a window frame, which can be used in the window assembly of the present invention, with the frame designed for a single thickness of glass.

In FIG. 3, frame 101, which can be used in place of frame 2 of FIG. 1, includes a first molding 102 and a second molding 103, connected by a flange area 104. Outwardly extending members 105 and 106, only partly shown, may be of any desired configuration, and serve to retain the window frame in the construction in which it is installed, as is conventional in the art. Hook engaging member 107 extends inwardly of flange 104, and has a hooked ledge 108, having a downwardly extending hook 109, at the inner extremity thereof.

Frame 2 of FIG. 1 is designed to be used with two different glazing strips, and two different window thicknesses, wherein a first glazing strip, designed to be used with a single window pane 4 is in hookable engagement with member 6 of frame 2. If a double window pane of insulating glass is to be used, a second smaller glazing member is generally used, and that glazing member will be in hookable engagement with member 7 of frame 2. In contrast, frame 101 of FIG. 3 is designed to be used with a single thickness of glass, although it is possible to use glazing strips of various widths, and thus suitable for use with panes of differing thicknesses, with either of the frames of FIGS. 1 and 3.

Figure 4:
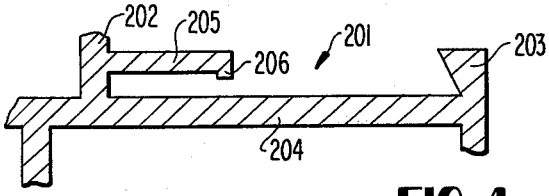
FIG. 4 is a cross-sectional view of part of a window frame, showing another embodiment of the frame which can be used in the present invention.

Frame 201 of FIG. 4 is yet another embodiment of window frame which can be used in the window assembly of the present invention. Frame 201 includes a first molding 202 and a second molding 203, connected by a flange area 204. Interiorly extending member 205 has a hook 206 located on the interior end thereof. The window pane (not shown) can rest directly upon member 205, or can be located a distance therefrom, as desired. In any event, hook 206 is in position to hookedly engage hook 13 of glazing member 3 of FIG. 1.

Figure 5:
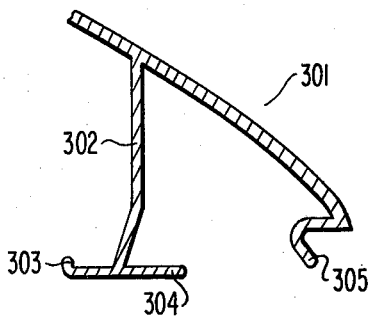
FIG. 5 is a cross-sectional view of a glazing strip, illustrating another embodiment of the glazing strip, which can be used with the window pane and the window frame of FIG. 1.

FIG. 5 represents an alternative construction of glazing strip. The glazing strip 301 of FIG. 5 is generally similar to the glazing strip 3 of FIG. 1, except that hook-shaped flange means 302, having hook 303 mounted thereon, also includes a interiorly extending flange 304. When used in the window frame 2, hook 303 is in hookable engagement with hook 14 of frame 2, when the window assembly is assembled. Flange 304 rest against the exterior wall of member 7 of flange 2, and serves to provide additional resistance to interior movement of flange member 302. The relatively dimensions of members 6 and 7 of flange 2, and the configuration of flange member 302, as well as the configuration and dimensions of hook 303 and flange member 304, must be chosen to permit hook 303 to be placed into the space between members 6 and 7, and glazing member 301 rotated outwardly about member 6 until retaining flange 305 engages second molding 8 of flange 2.

While the above description has been with reference to the glazing bead being located on that side of the window which faces the interior of the structure containing the window, it will be clear that the glazing bead can also be located on the exterior side of the window. With the glazing bead located on the exterior side of the window, the window can be readily replaced from the exterior of the building, which may advantageous in some instances. For instance, awning windows are normally constructed so that the glazing bead will be on the side of the window which is exposed to the exterior. Thus, in the above description and in the following claims, the reference to interior and exterior is for purposes of general orientation, and is not intended to require that the window be oriented so that the glazing bead is in one particular direction, with reference to the interior of the building.

I claim:

1. A window assembly comprising a window pane and a frame assembly generally surrounding said pane, said window assembly capable of resisting high wind loads, even up to the breaking point of the pane, yet permitting easy installation and removal of said pane in said frame assembly, said frame assembly comprising a frame and a removable glazing member, said frame in cross-section comprising an interior side and opposite, exterior side, and an inner side and an opposite, outer side, the plane of the exterior sides and the interior sides being generally parallel to the plane of said pane, said frame provided with an inwardly extending first molding on the exterior side thereof, an inwardly extending second molding on the opposite side of said frame, a flange extending between said first and second moldings, and hook engaging means located generally between the pane and the second molding and inward of said flange, said hook engaging means having a hook-shaped portion generally facing outward and opening away from said pane, said hook-shaped portion having a first portion thereof extending in a generally inner direction, a second portion thereof connected to the first portion and extending in an interior direction, and a third portion thereof connected to the second portion and extending in an outer direction, said glazing member comprising a retaining flange means at one edge thereof engaging said second molding, a glazing bead on the opposite side of said glazing member from said retaining flange means, and a hook-shaped flange means extending generally outwardly of said glazing member from a location between said glazing bead and said retaining flange means in position to hookedly interengage said hook engaging means, the hook-shaped portion of said hook-shaped flange means generally facing inward and opening towards said pane, said pane located between, and retained in said frame by, said first molding and said glazing bead, said hook-shaped flange means and said hook engaging means cooperating so that said glazing bead is insertable in and removable from said frame without damage thereto, and when said pane is under substantially no load said hook-shaped flange means and said hook engaging means are not interengaged but when load is applied to the exterior of said pane, said glazing member rotates inwardly away from said flange about said second molding to place said hook-shaped flange means in hooked interengagement with said hook engaging means, said hooked flange means and said hook engaging means cooperating when in hooked interengagement to substantially prevent further rotational movement of said glazing member away from said flange about said second molding.

2. Assembly of claim 1 wherein said window pane is a glass window pane.

3. Assembly of claim 2 wherein a plurality of hook engaging means are provided on said frame.

4. Assembly of claim 2 wherein said assembly further includes glazing compound located in the area between said molding and said window pane.

* * * * *